US005720551A

United States Patent [19]

Shechter

[11] Patent Number: 5,720,551

[45] Date of Patent: Feb. 24, 1998

[54] FORMING EMULSIONS

[76] Inventor: Tal Shechter, 12 Bayberry La., Randolph, Mass. 02368

[21] Appl. No.: 330,448

[22] Filed: Oct. 28, 1994

[51] Int. Cl.[6] ..... B01F 5/08; B01F 15/06

[52] U.S. Cl. ..... 366/147; 366/176.1; 366/181.5; 366/336

[58] Field of Search ..... 366/336, 337, 366/338, 339, 340, 15.01, 162.4, 162.5, 165.2, 165.4, 167.1, 178.1, 182.1, 147, 176.1, 181.5

[56] References Cited

U.S. PATENT DOCUMENTS

| | | | |
|---|---|---|---|
| 1,496,858 | 6/1924 | Knollenberg . | |
| 1,593,762 | 7/1926 | Heitmann . | |
| 2,068,136 | 1/1937 | Hulberg | 252/6 |
| 2,584,805 | 2/1952 | Lefwich | 60/39.05 |
| 2,882,025 | 4/1959 | Loo . | |
| 3,153,578 | 10/1964 | Taylor | 366/336 |
| 3,459,407 | 8/1969 | Hazlehurst et al. . | |
| 3,476,521 | 11/1969 | Wise . | |
| 3,852,013 | 12/1974 | Upmeier | 425/376 |
| 3,941,355 | 3/1976 | Simpson . | |
| 3,941,552 | 3/1976 | Cottell | 431/2 |
| 3,965,975 | 6/1976 | Edmundson . | |
| 4,081,863 | 3/1978 | Rees | 366/176 |
| 4,087,862 | 5/1978 | Tsien | 366/165 |
| 4,124,309 | 11/1978 | Yao | 366/340 |
| 4,159,881 | 7/1979 | Gogneau . | |
| 4,299,498 | 11/1981 | Sauerbrunn . | |
| 4,337,161 | 6/1982 | Stayner | 252/49.5 |
| 4,440,500 | 4/1984 | Schneider | 366/177 |
| 4,452,917 | 6/1984 | Proksa et al. . | |
| 4,533,254 | 8/1985 | Cook et al. | 366/176 |
| 4,597,671 | 7/1986 | Marelli | 366/127 |
| 4,701,055 | 10/1987 | Anderson . | |

(List continued on next page.)

FOREIGN PATENT DOCUMENTS 0 568 070 A1 3/1993 European Pat. Off. .

OTHER PUBLICATIONS

Schubert et al., "Principles of Formation and Stability of Emulsions", International Chemical Engineering, vol. 32, No. 1, Jan., 1992, pp. 14–28, Federal Republic of Germany.

APV Gauli Brochure, pp. 2–11.

Takamura et al., "The Influence of Cooling Rate on Emulsion Stability", Translation of Japanese Article, Presented at 101st Japan Pharmaceutical Academy Conference at Kumamoto, Apr., 1981.

Jeffries et al., "Thermal Equilibration During Cavitation", *Science*, Apr. 10, 1992, vol. 256, No. 5054, p. 248.

*Primary Examiner*—Charles E. Cooley
*Attorney, Agent, or Firm*—Fish & Richardson P.C.

[57] ABSTRACT

Emulsification is achieved by directing a jet of fluid along a first path, and interposing a structure in the first path to cause the fluid to be redirected in a controlled flow along a new path, the first path and the new path being oriented to cause shear and cavitation in the fluid. A hot emulsion is stabilized immediately after formation by causing the emulsion to flow away from the outlet end of an emulsion forming structure, and causing a cooling fluid to flow in a direction generally opposite to the flow of the emulsion and in close enough proximity to exchange heat with the emulsion flow. In another aspect, emulsification of a first fluid component within a second fluid component is achieved by providing an essentially stagnant supply of the first fluid component in a cavity, and directing a jet of the second fluid component into the first fluid component, with the temperatures and the jet velocities of the fluids being chosen to cause cavitation due to hydraulic separation at the interface between the two fluids. In other aspects, a coiled tube is used to reduce pressure fluctuations in an emulsifying cell fed from a fluid line by a high pressure pump; A two-piece nozzle is used in an emulsification structure; an absorption cell has a reflective surface at the end of the chamber for reflecting the jet, and a mechanism is provided for adjusting the distance from the reflective surface to the open end; a modular emulsification structure includes a series of couplings that can be fitted together in a variety of ways.

20 Claims, 13 Drawing Sheets

U.S. PATENT DOCUMENTS 4,723,715 2/1988 Mazurkiewicz ..... 241/1
4,908,154 3/1990 Cook et al. ..... 252/314
5,035,362 7/1991 Mazurkeiwicz ..... 241/1
5,147,412 9/1992 Klinksiek et al. .
5,279,463 1/1994 Holl ..... 241/1
5,289,981 3/1994 Kamiwano et al. ..... 241/261.1
5,366,287 11/1994 Verstallen ..... 366/336

EMULSIFIER
OIL
WATER
FEED TANK
FINISHED EMULSION
H.P. PUMP
EMULSIFYING CELL
HEATING SYSTEM
COOLING SYSTEM
P
PI
TI
V
110
112
114
118
120
122
124
126
128
130
132
134
136
138
140
142
144
146
148
150
152
154
156
158
162
164
166
168
170
172
174
176

FORMING EMULSIONS

BACKGROUND OF THE INVENTION

This invention relates to forming emulsions.

We use the term "emulsion" for a system comprising two immiscible liquid phases, with one phase dispersed as small droplets in the other phase. For simplicity we will call the dispersed phase "oil" and the continuous phase "water", although the actual components may vary widely. As additional components, emulsifying agents, known as emulsifiers or surfactants, serve to stabilize emulsions and facilitate their formation, by surrounding the oil phase droplets and separating them from the water phase.

The uses of emulsions have been increasing for many years. Most processed food and beverage products, medicine and personal care products, paints, inks, toners, and photographic media are either emulsions or employ emulsions. In recent years, demand for emulsions with smaller and more uniform droplets has increased. Artificial blood applications, for example, require nearly uniform droplets averaging 0.2 micrometers. Jet-ink printing has similar requirements of size and distribution.

High pressure homogenizers are often used to produce small and uniform droplets or particles, employing a device which is commonly referred to as an homogenizing valve. The valve is kept closed by a plug forced against a seat by means of a spring or hydraulic or pneumatic pressure. The pre-mixed raw emulsion is fed at a high pressure, generally between 1,000 and 15,000 psi, to the center of the valve seat. When the fluid pressure overcomes the force closing the valve, a narrow annular gap (10–200 um) is opened between the valve seat and the valve plug. The raw emulsion flows through, undergoing rapid acceleration as well as sudden drop in pressure which breaks down the oil phase into small droplets. More recently, a new type of high pressure homogenizer was introduced, employing two or more fixed orifices, and capable of reaching 40,000 psi. When forced through these orifices, the pre-mixed raw emulsion forms liquid jets which are caused to impinge at each other. A description is found in U.S. Pat. Nos. 4,533,254 and 4,908,154.

The typical mechanism for emulsification in this type of device is the controlled use of shear, impact, and cavitation forces in a small zone. The relative effects of these forces generally depend on the fluid's characteristics, but in the vast majority of emulsion preparation schemes, cavitation is the dominant force.

Fluid shear is created by differential velocity within the fluid stream, generated by the sudden fluid acceleration upon entering the orifice or small gap, by the difference between the extremely high velocity at the center of the orifice and zero velocity at the surfaces defining the orifice, and by the intense turbulence which occurs after exiting the orifice.

Cavitation takes place when pressure drops momentarily below the vapor pressure of the water phase. Small vapor bubbles form and then collapse (within 10–3 to 10–9 sec.), generating shock waves which break down surrounding oil droplets. Cavitation occurs in homogenizing valves when the sudden acceleration in the orifice, with a simultaneous pressure drop, causes the local pressure to drop momentarily below the vapor pressure.

More generally, it has become known that cavitation occurs when two surfaces are separated faster than some critical velocity, and that cavitation bubbles affect their surrounding only during the formation of the cavities, and not during the collapse of the cavities, as had been long assumed. Another discovery of interest is that cavitation can occur either totally within the liquid, or at the solid-liquid interfaces, depending on the relative strength of solid-liquid adhesion and the liquid-liquid cohesion.

Typical emulsification schemes have several characteristics worth noting. Cavitation takes place only once, for a very short time (10–3 to 10–9 seconds), and equipment which employs high power density imparts emulsification energy only to a very small portion of the product at any given time. The emulsification process is thus highly sensitive to the uniformity of the feed stock, and several passes through the equipment are usually required before the desired average droplet size and uniformity are achieved. The final droplet size depends on the surfactant's rate of interaction with the oil phase. Because surfactants cannot generally surround the oil droplets at the same rate they are being formed by the emulsifying process, agglomeration takes place and average droplets size increases. There is a typical sharp increase in product temperature during the process, which limits the choice of emulsion ingredients and processing pressure, as well as accelerating the agglomeration rate of the droplets after the emulsification process. Some processes require very small solid polymer or resin particles; and this is often accomplished by dissolving solid polymers or resins in VOC's (volatile organic compounds), then employing mixing equipment to reduce the droplets size, and finally removing the VOC.

SUMMARY OF THE INVENTION

In general, in one aspect, the invention features a method for use in causing emulsification in a fluid. In the method, a jet of fluid is directed along a first path, and a structure is interposed in the first path to cause the fluid to be redirected in a controlled flow along a new path, the first path and the new path being oriented to cause shear and cavitation in the fluid.

Implementations of the invention may include the following features.

The first path and the new path may be oriented in essentially opposite directions. The coherent flow may be a cylinder surrounding the jet. The interposed structure may have a reflecting surface that is generally semi-spherical, or is generally tapered, and lies at the end of a well. Adjustments may be made to the pressure in the well, in the distance from the opening of the well to the reflecting surface, and in the size of the opening to the well. The controlled flow, as it exits the well, may be directed in an annular sheet away from the opening of the well. An annular flow of a coolant may be directed in a direction opposite to the direction of the annular sheet.

In general, in another aspect, the invention features a method for use in stabilizing a hot emulsion immediately after formation. The emulsion is caused to flow away from the outlet end of an emulsion forming structure, and a cooling fluid is caused to flow in a direction generally opposite to the flow of the emulsion and in close enough proximity to exchange heat with the emulsion flow.

Implementations of the invention may include the following features. The emulsion may be formed as a thin annular sheet as it flows out of the emulsion forming structure. The cooling fluid may be a thin annular sheet as it flows opposite to the emulsion. The cooling fluid may be a liquid or gas compatible with the emulsion. The flows of the emulsion and the cooling fluid may occur in an annular valve opening.

In general, in another aspect, the invention features a method for use in causing emulsification of a first fluid component within a second fluid component. In the method, an essentially stagnant supply of the first fluid component is provided in a cavity. A jet of the second fluid component is directed into the second fluid component. The temperatures and the jet velocities of the fluids are chosen to cause cavitation due to hydraulic separation at the interface between the two fluids.

Implementations of the invention may include the following features. The second fluid component may include a continuous phase of an emulsion or dispersion. The first fluid component may be a discontinuous phase in the emulsion, e.g., a solid discontinuous phase. The second fluid may be provided in an annular chamber, and the jet may be delivered from an outlet of an orifice which opens into the annular chamber. After emulsification by hydraulic separation, the product may be passed through an orifice to cause additional emulsification, or may be delivered to a subsequent processing chamber, where an additional component may be added to the emulsion. A cooling fluid may be applied to the product in the subsequent processing chamber to quickly cool and stabilize the emulsion. The subsequent processing chamber may be an absorption cell into which a jet of the product is directed.

In general, in another aspect, the invention features an apparatus for reducing pressure fluctuations in an emulsifying cell fed from a fluid line by a high pressure pump. A coiled tube in the fluid line between the pump and the emulsifying cell has internal volume, wall thickness, coil diameter and coiling pattern adequate to absorb the pressure fluctuations and capable of withstanding the high pressure generated by the pump. The apparatus may include a shell around the coiled tube with ports for filling the shell with heating or cooling fluid.

In general, in another aspect, the invention features a nozzle for use in an emulsification structure. In the structure, two body pieces having flat surfaces mate to form the nozzle, at least one of the members having a groove to form an orifice in the nozzle. The surfaces are sufficiently flat so that when the two body pieces are pressed together with sufficient force, fluid flow is confined to the orifice. In implementations of the invention, the cavitation inducing surfaces may be defined on the groove; and a wall of the groove may be coated with diamond or non-polar materials or polar materials.

In general, in another aspect, the invention features an absorption cell for use in an emulsification structure. The cell includes an elongated chamber having an open end for receiving a jet of fluid having two immiscible components. A reflective surface is provided at the other end of the chamber for reflecting the jet. And a mechanism is provided for adjusting the distance from the reflective surface to the open end.

Implementations of the invention may include the following features. The reflective surfaces may be interchangeable for different applications. There may be a removable insert for insertion into the chamber at the open end, the insert having an orifice of a smaller dimension than the inner wall of the chamber. There may be several different inserts each suitable for a different application.

In general, in another aspect, the invention features a modular emulsification structure comprising a series of couplings that can be fitted together in a variety of ways. Each of at least one of the couplings includes an annular male sealing surface at one end of the coupling, and an annular female sealing surface at the other end of the coupling. An opening is provided between the male and female sealing surfaces, for communicating fluid from a up-stream coupling to a down-stream coupling. Ports are provided for feeding fluid into or withdrawing fluid from the coupling. At least some of the communicating openings are sufficiently small to form a liquid jet. The sealing surfaces are sufficiently smooth to provide a fluid-tight seal when the couplings are held together by a sufficient compressive force directed along the length of the structure.

Implementations of the invention may include the following features. A processing chamber may be defined between the male sealing surface of one of the up-stream couplings and the female sealing surface of one of the down-stream couplings. In some of the couplings, the orifice may extend from one end of the coupling to the other. An absorption cell coupling may be used at one of the structure. One of the couplings may extend into another coupling to form a small annular opening for generating an annular flow sheet of cooling fluid. Some of the ports in the couplings are used for CIP/SIP cleaning and/or sterilization procedures.

Advantages of the invention include the following.

Very small liquid droplets or solid particles may be processed in the course of emulsifying, mixing, suspending, dispersing, or de-agglomerating solid and/or liquid materials. Nearly uniform sub-micron droplets or particles are produced. The process is uniform over time because pressure spikes that are normally generated by the high pressure pump are eliminated. A broader range of types of emulsion ingredients may be used while maximizing their effectiveness by introducing them separately into the high velocity fluid jet. Fine emulsions may be produced using fast reacting ingredients, by adding each ingredient separately and by controlling the locations of their interaction. Control of temperature before and during emulsification allows multiple cavitation stages without damaging heat sensitive ingredients, by enabling injection of ingredients at different temperatures and by injecting compressed air or liquid nitrogen prior to the final emulsification step. The effects of cavitation on the liquid stream are maximized while minimizing the wear effects on the surrounding solid surfaces, by controlling orifice geometry, materials selection, surface characteristics, pressure and temperature. Absorption of the jet's kinetic energy into the fluid stream is maximized, while minimizing its wear effect on surrounding solid surfaces. A sufficient turbulence is achieved to prevent agglomeration before the surfactants can fully react with the newly formed droplets. Agglomeration after treatment is minimized by rapid cooling, by injecting compressed air or nitrogen and/or by rapid heat exchange, while the emulsion is subjected to sufficient turbulence to overcome the oil droplets' attractive forces and maintaining sufficient pressure to prevent the water from vaporizing.

Scale-up procedures from small laboratory scale devices to large production scale systems is made simpler because every process parameter can be carefully controlled. The invention is applicable to emulsions, microemulsions, dispersions, liposomes, and cell rupture. A wide variety of immiscible liquids may be used, in a wider range of ratios. Smaller amounts of (in some cases no) emulsifiers are required. Emulsions can be produced in one pass through the process. The reproducibility of the process is improved. A wide variety of emulsions may be produced for diverse uses such as food, beverages, pharmaceuticals, paints, inks, toners, fuels, magnetic media, and cosmetics. The apparatus is easy to assemble, disassemble, clean, and maintain. The process may be used with fluids of high viscosity, high solid content, and fluids which are abrasive and corrosive.

The emulsification effect continues long enough for surfactants to react with newly formed oil droplets. Multiple stages of cavitation assure complete use of the surfactant with virtually no waist in the form of micelles. Multiple ports along the process stream may be used for cooling by injecting ingredient at lower temperature. VOC's may be replaced with hot water to produce the same end products. The water will be heated under high pressure to well above the melting point of the polymer or resin. The solid polymer or resins will be injected in its solid state, to be melted and pulverized by the hot water jet. The provision of multiple ports eliminates the problematic introduction of large solid particles into the high pressure pumps, and requires only standard industrial pumps.

Other advantages and features will become apparent from the following description and from the claims.

DESCRIPTION OF THE PREFERRED EMBODIMENTS

Figure 1:
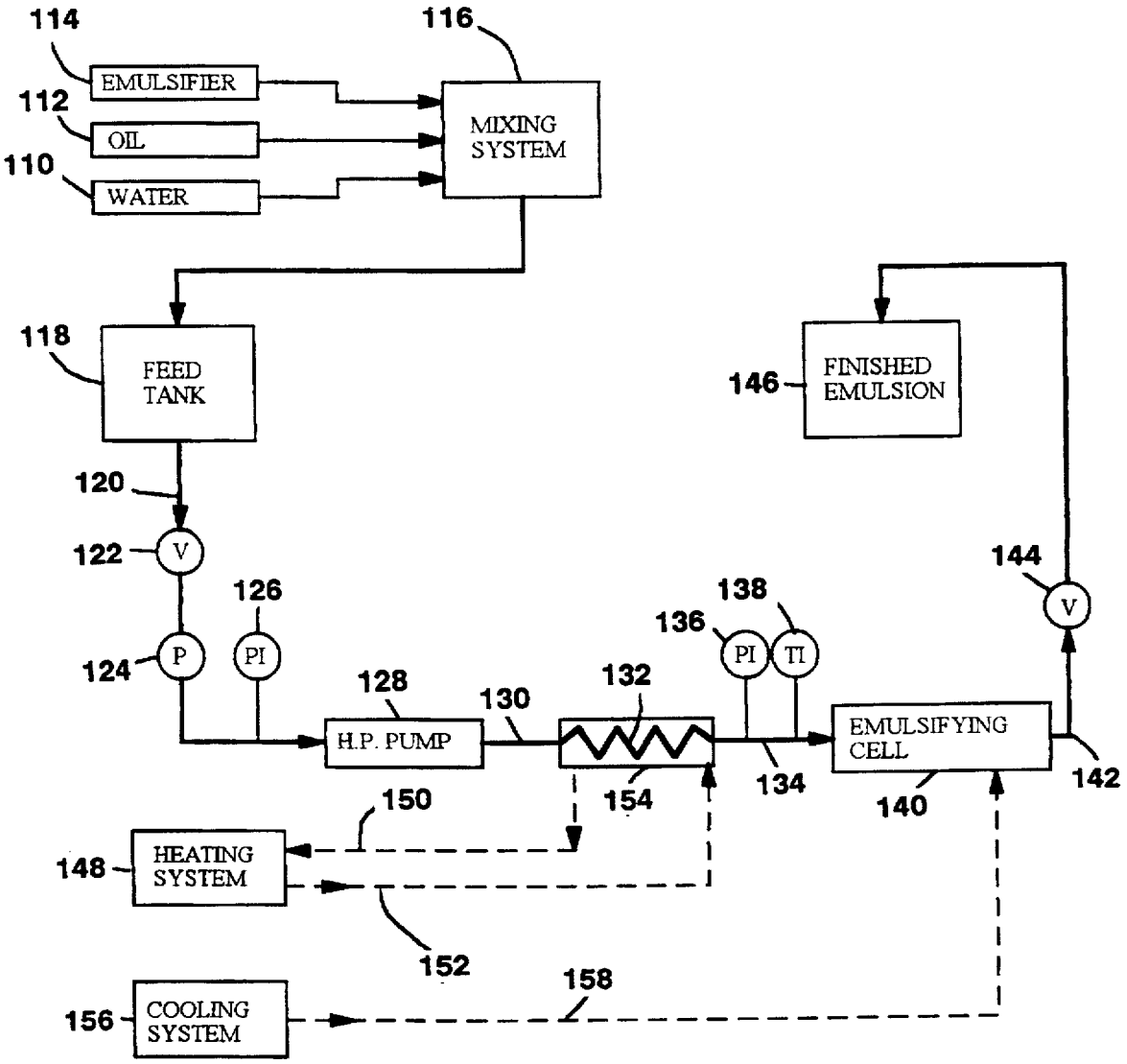
FIGS. 1 and 2 are block diagrams of emulsification systems.

In FIG. 1, the product ingredients are supplied from sources 110, 112, and 114 into a pre-mixing system 116. For simplicity, only three types of ingredients are shown by way of example: water, oil, and emulsifier; but a wide variety of other ingredients could be used depending on the product to be made. The pre-mixing system 116 is of a suitable kind (e.g. propeller mixer, colloid mill, homogenizer, etc.) for the type of product. After pre-mixing, the ingredients are fed into the feed tank 118. In some cases, the pre-mixing may be performed inside feed tank 118. The pre-mixed product from tank 118 then flows through line 120 and valve 122, by means of transfer pump 124 to the high pressure process pump 128. Transfer pump 124 may be any type of pump normally used for the product, provided it can generate the required feed pressure for proper operation of the high pressure process pump. Pressure indicator 126 is provided to monitor feed pressure to pump 128. The high pressure process pump 128 is typically a positive displacement pump, e.g., a triplex or intensifier pump. From process pump 128 the product flows at high pressure through line 130 into coil 132, where pressure fluctuations generated by the action of pump 128 are regulated by expansion and contraction of the coil tubing. A more detailed explanation of the coil mechanism is given in the description of FIGS. 12A through 12C. It may be desirable or necessary to heat or cool the feed stock. Heating system 148 may circulate hot fluid in shell 154 via lines 150 and 152, or cooling system 156 may be used. The heating medium may be hot oil or steam with the appropriate means to control the temperature and flow of the hot fluid, such that the desired product temperature is attained upon exiting coil 132. The product exits coil 132 through line 134, where pressure indictor 136 and temperature indicator 138 monitor these parameters, and enters the emulsifying cell 140 at a high and constant pressure, for example a pressure of 15,000 psi.

The emulsification process takes place in emulsifying cell 140, where the feed stock is forced through at least one jet generating orifice and through an absorption cell wherein the jet's kinetic energy is absorbed by a fluid stream flowing around the jet and in the opposite direction. In each of the treatment stages (there may be more than two), intense forces of shear, impact, and/or cavitation break down the oil phase into extremely small and highly uniform droplets, and sufficient time is allowed for the emulsifier to interact with these small oil droplets to stabilize the emulsion.

Immediately following the emulsification process, cooling fluid from cooling system 156 is injected into the emulsion via line 158, cooling the emulsion instantly by intimate mixing of the cooling fluid with the hot emulsion inside emulsification cell 140. Cooling system 156, may be a source of cool compatible liquid (e.g., cold water) or of compressed gas (e.g., air or nitrogen), with suitable means to control the temperature, pressure and flow of the cooling fluid, such that the desired product temperature is attained upon exiting emulsification cell 140. The emulsion exits the emulsification cell 140 through line 142, where metering valve 144 is provided to control back-pressure during cooling, and ensuring that the hot emulsion remains in liquid state while being cooled, thereby maintaining the emulsion integrity and stability. Finally, the finished product is collected in tank 146.

Figure 2:
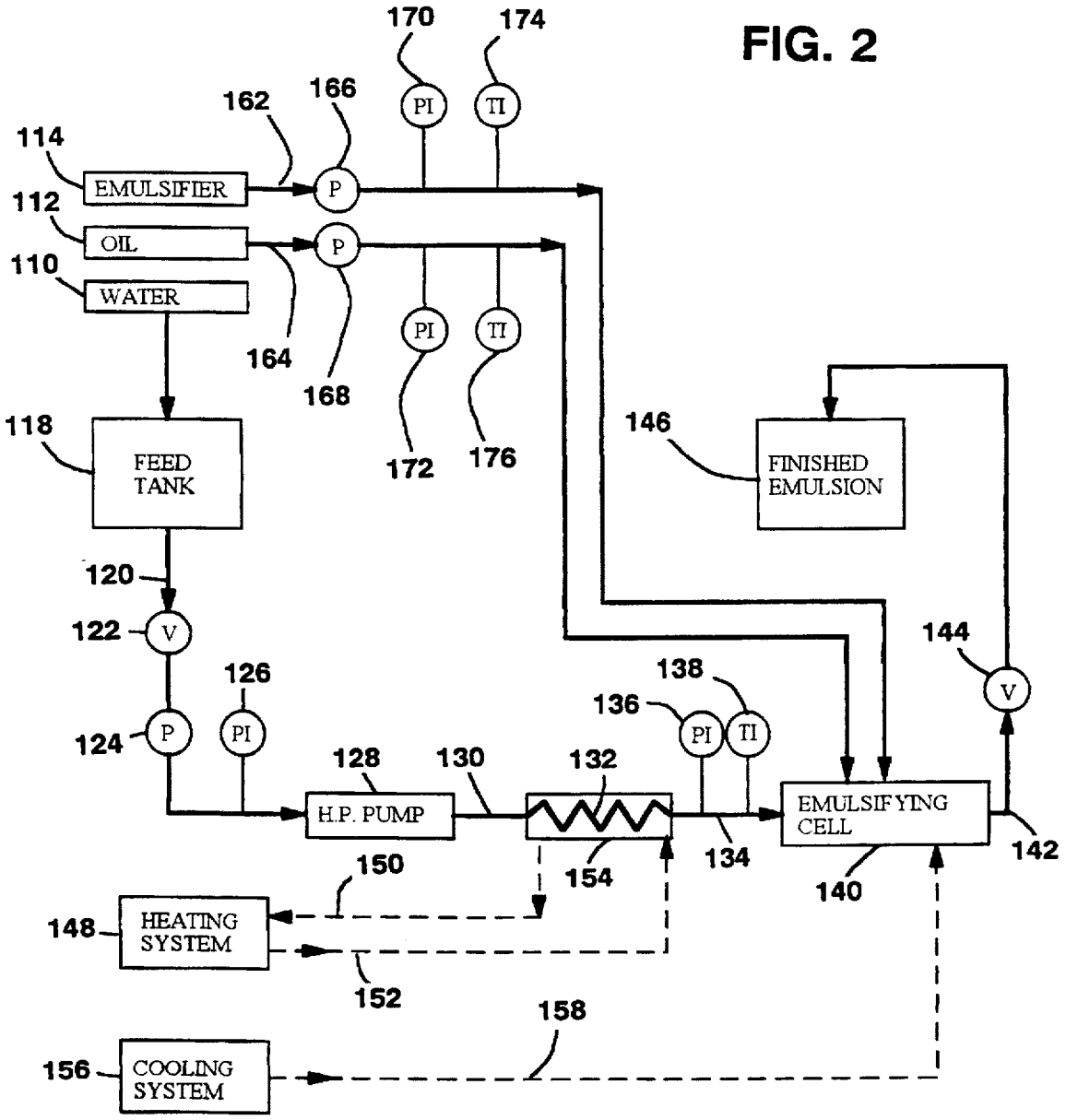

In the system illustrated by FIG. 2, the product's continuous phase is supplied from supply 110 into feeding tank 118, while other ingredients are supplied from sources 112 and 114 directly into the emulsifying cell 140. Some ingredients may be mixed together to reduce the number of separate feed lines, or there may be as many feed lines as product ingredients.

Water from tank 118 flows through line 120 and valve 122, by means of transfer pump 124 to the high pressure process pump 128. Elements 128 through 138, and 148 through 158 have similar functions to the same numbered elements of the system of FIG. 1.

Oil and emulsifier, each representing a possibly unlimited number and variety of ingredients which may be introduced separately, flow from sources 112 and 114 into emulsifying cell 140, through lines 162 and 164, each with a pressure indicator 170 and 172, and a temperature indicator 174 and 176, by means of metering pumps 166 and 168. Metering pumps 166 and 168 are suitable for type of product pumped (e.g. sanitary cream, injectable suspension, abrasive slurry) and the required flow and pressure ranges. For example, in small scale systems peristaltic pumps are used, while in production system and/or for high pressure injection, diaphragm or gear pumps are used.

Inside emulsifying cell 140 the water is forced through an orifice, creating a water jet. Other product ingredients, as exemplified by the oil and emulsifier, are injected into emulsifying cell 140. The interaction between the extremely high velocity water jet inside emulsifying cell 140 and the stagnant ingredients from lines 162 and 164, subjects the product to a series of treatment stages, in each of which intense forces of shear, impact, and/or cavitation break down the oil and emulsifier to extremely small and highly uniform droplets, and allows sufficient time for the emulsifier to interact with the oil droplets. Immediately following the emulsification process, the emulsion is cooled and then exits the emulsification cell and is collected, all in a manner similar to the one used in the system of FIG. 1.

As seen in FIGS. 3 through 9, the emulsifying cell is constructed using a series of interchangeable couplings, each for a particular purpose. The couplings are used to form an integral pressure containing unit by forcing together a smooth and tapered sealing surface of each coupling into a smooth and tapered corresponding sealing surface in the adjacent coupling, to create a metal-to-metal seal, much like the seal between a standard high pressure nipple and the corresponding female port. Each coupling (except possibly for the end couplings) has a large bore in one side, and a matching protrusion of slightly smaller diameter on the other side, such that each coupling's protrusion fits into the bore of the next coupling, thereby aligning sealing surfaces and facilitating assembly of a large number of couplings. The couplings are fastened together by four bolts.

Figure 3A:
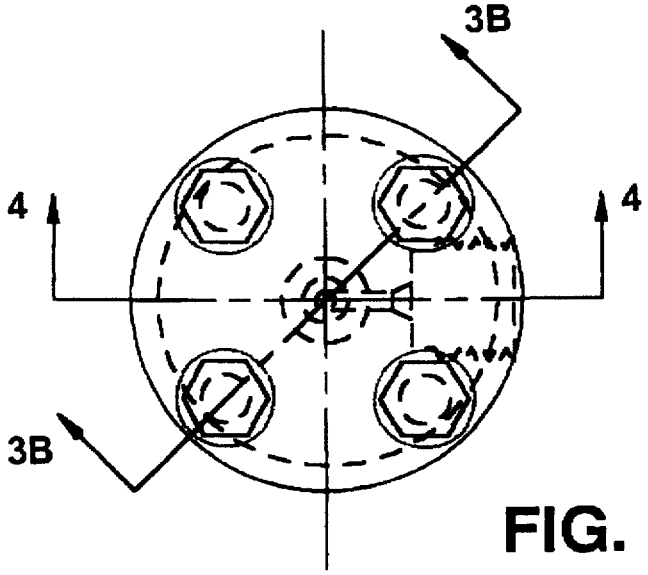
FIGS. 3A and 3B are an end view and a cross-sectional view (at 3A—3A of FIG. 3A) of an emulsifying cell assembly.
Figure 3B:
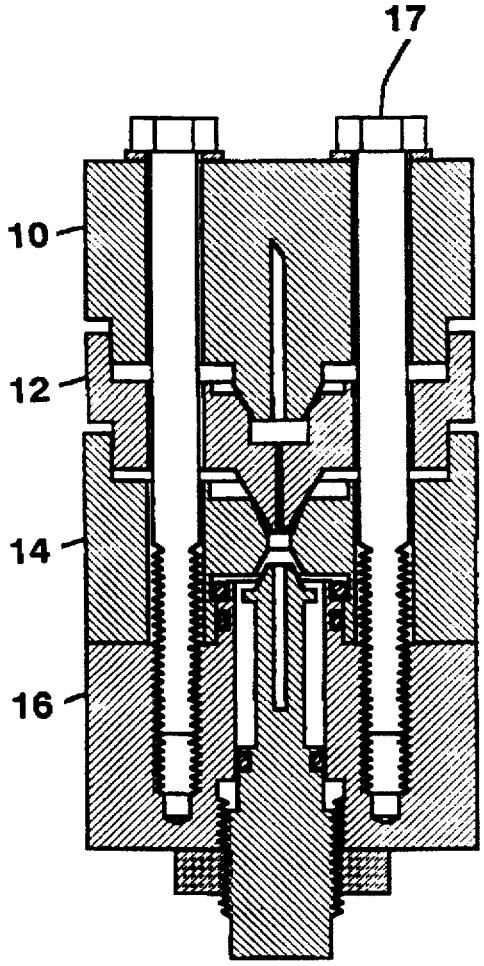
Figure 4:
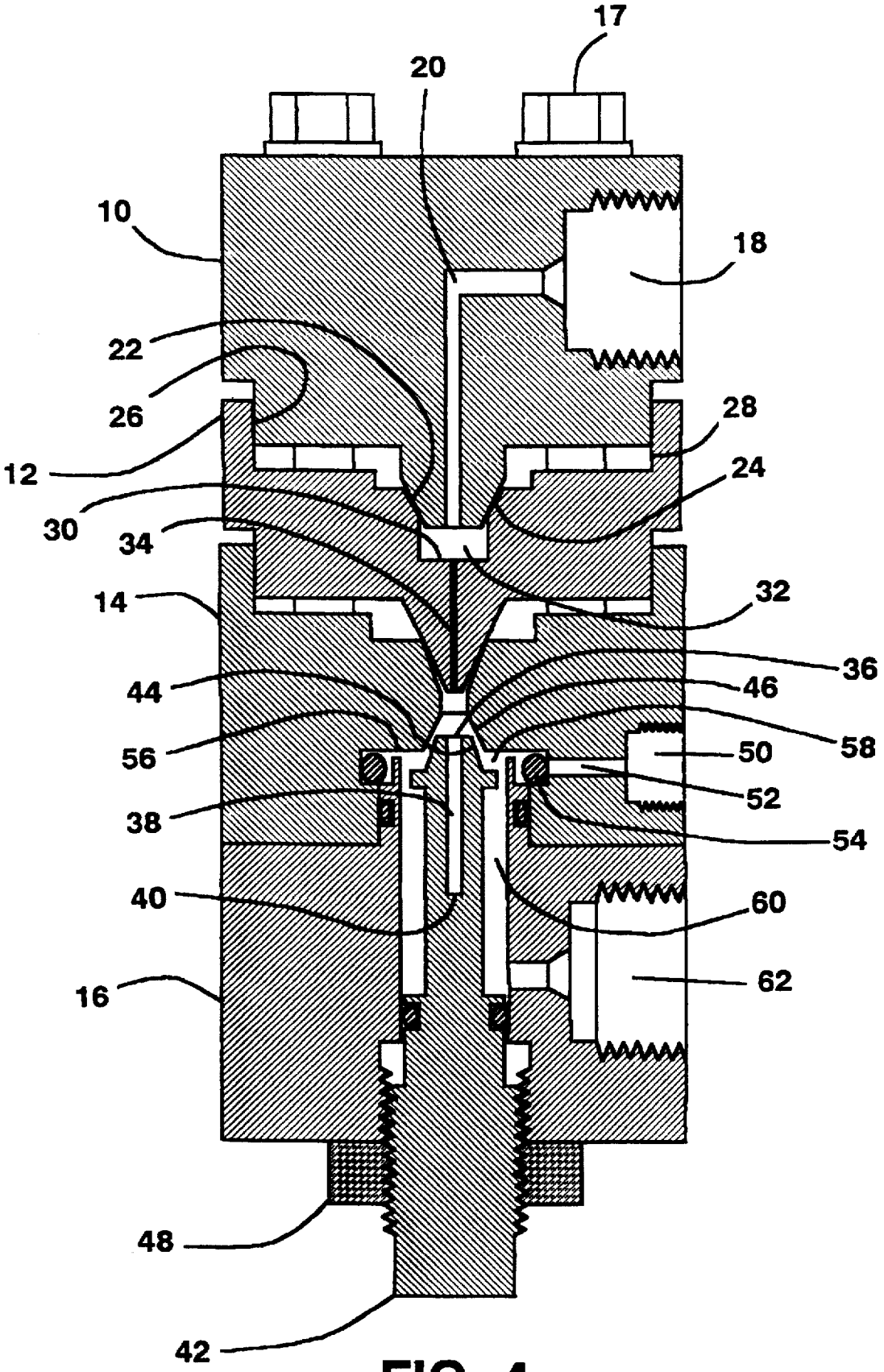
FIG. 4 is a larger scale cross-sectional view (at 4—4 of FIG. 3A) of the emulsifying cell assembly.

In the example of a basic emulsifying cell shown in FIGS. 3A and 3B, the cell assembly has four couplings: product inlet coupling 10, nozzle coupling 12, coolant inlet coupling 14, and product outlet coupling 16. Referring also to FIG. 4, protrusion 26 of coupling 10 fits into bore 28 in coupling 12, while sealing surface 22 of coupling 10 is aligned with sealing surface 24 in coupling 12, to form a pressure containing metal-to-metal seal upon fastening of the assembly with four bolts 17. The product fluid to be processed enters the emulsifying cell from port 18, which is a standard ¼" H/P port (e.g., Autoclave Engineers #F250C), and flows through round opening 20 (0.093" dia. hole). Ejecting from opening 20, the product impinges on surface 30 of coupling 12, and then flows in a random turbulent pattern inside a generally cylindrical cavity 32, which is formed between couplings 10 and 12.

Figure 6:
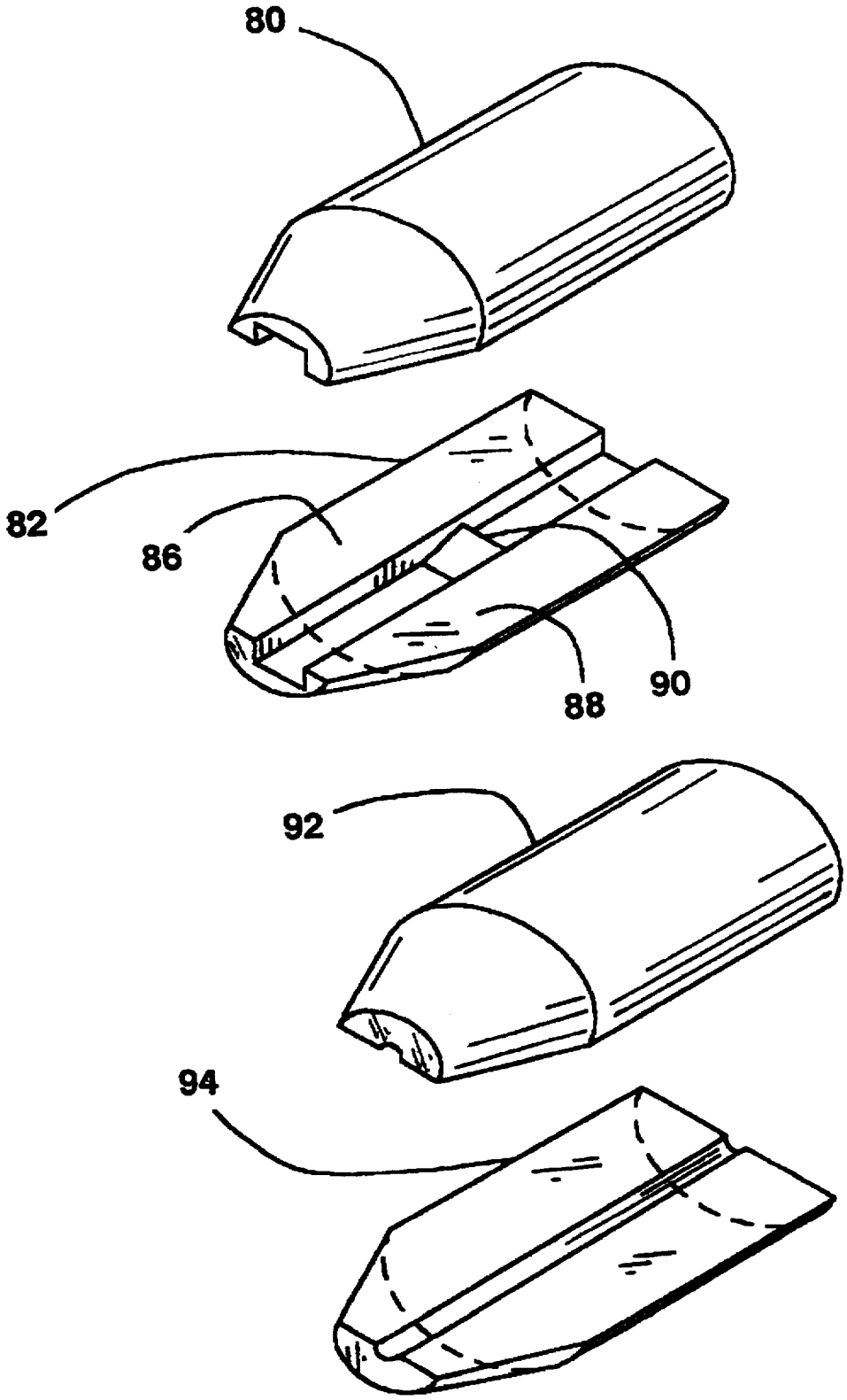
FIG. 6 is an isometric exploded view, not to scale, of two types of a two-piece nozzle assembly.
Figure 7A:
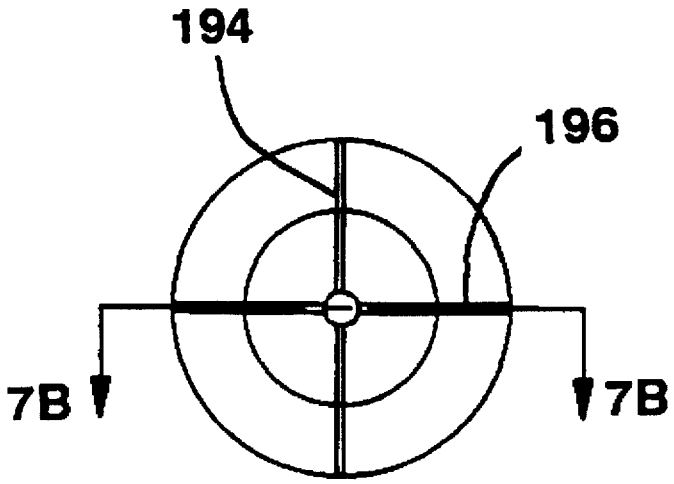
FIGS. 7A and 7B are an enlarged end view and a cross-sectional view of an adapter for the two-piece nozzle assembly.
Figure 7B:
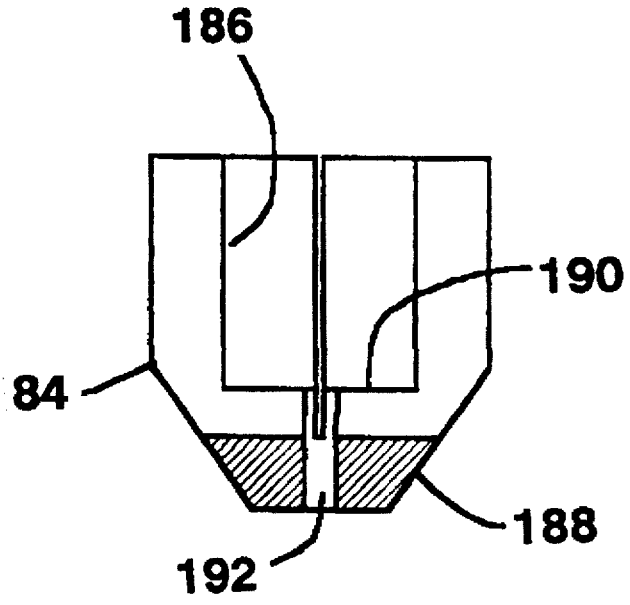
Figure 8:
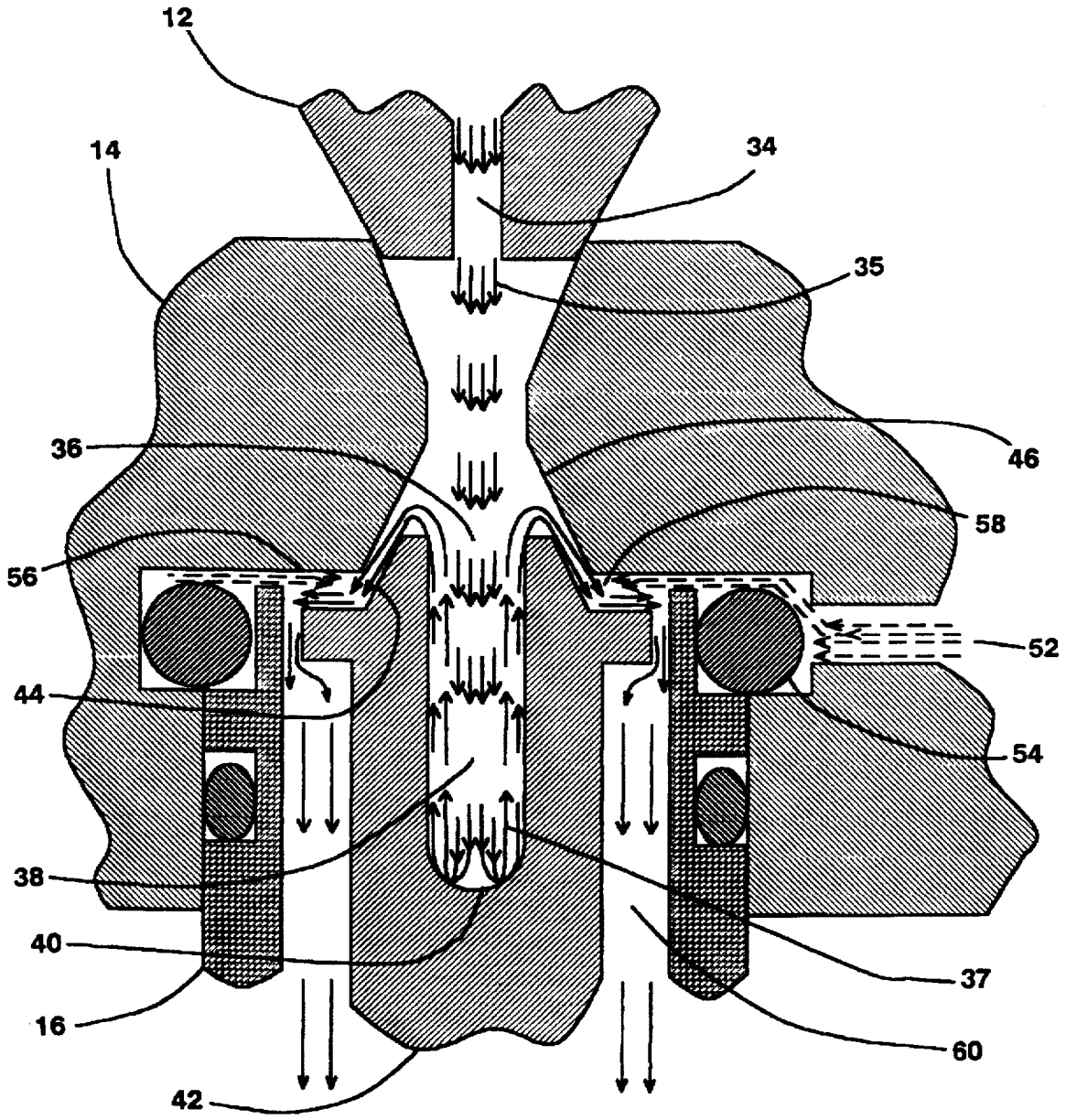
FIG. 8 is a schematic cross-sectional diagram, not to scale, of fluid flow in an absorption cell.
Figure 9:
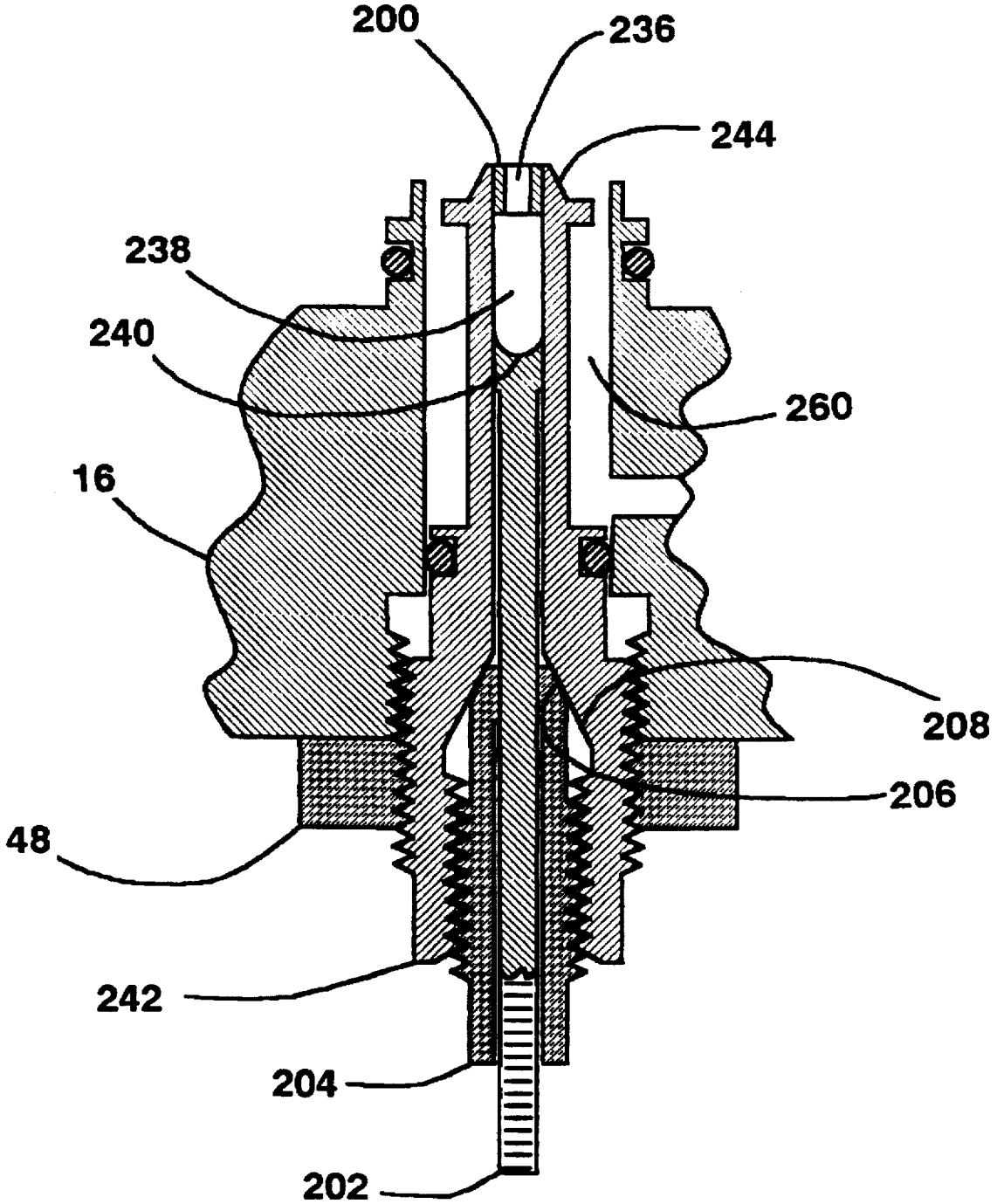
FIG. 9 is a cross-sectional view of an absorption cell.

Thus, from virtually zero velocity in the axial direction in cavity 32, the product is accelerated to a velocity exceeding 500 ft/sec upon entering orifice 34. This sudden acceleration which occurs simultaneously with a severe pressure drop causes cavitation in the orifice. Being a one piece metallic nozzle, coupling 12 is suitable for relatively low pressure applications in the range of 500 psi to 15,000 psi of liquid-liquid emulsions. Applications requiring higher pressure, or which contain solids, require a 2-piece nozzle assembly as shown in FIG. 6. The diameter of orifice 34 determines the maximum attainable pressure for any given flow capacity. For example a 0.015 in. diameter hole will enable 10,000 psi with a flow rate of 1 liter/min. of water. More viscous products require an orifice as large as 0.032 in. diameter to attain the same pressure and flow rate, while smaller systems with pumps' capacity under 1 liter/min. require an orifice as small as 0.005 in. diameter to attain 10,000 psi. The high velocity jet is ejected from orifice 34 into an absorption cell cavity 38, the flow pattern of which is shown in FIG. 8. An alternate absorption cell is shown in FIG. 9.

Referring now to FIG. 8, water jet 35 formed in orifice 34 is maintained essentially unchanged as it flows through opening 36 of the absorption cell. After impacting surface 40, which may be flat or semi-spherical, or have another configuration otherwise enhancing its function, the jet fluid reverses its flow direction, and forms a coherent cylindrical flow stream 37. The cylindrical flow pattern is formed because that is the only way for the fluid to exit cavity 38. With opening 36 only slightly larger than orifice 34, fluid stream 37 is forced to react with the jet fluid 35, thereby absorbing the kinetic energy of the jet fluid, generating intense forces of shear and cavitation, and minimizing the wear effect of the jet impacting on surface 40. The intensity of energy input into the product is much lower in cavity 38 than in orifice 34. Rather than further breaking down oil droplets, the interaction of the two streams in cavity 38 serves to provide sufficient time for the emulsifier to interact with the oil droplets formed in orifice 34 and completely surround them, thereby maintaining the oil droplets at the same small size achieved in orifice 34 and preventing their agglomeration. The absorption cell provides a controllable environment for the interaction to occur, depending on the diameter of the bore, the shape of the impact surface at the end of the cell, the length of the cell, and other design factors.

Cavity 38 is formed inside stem 42, which is threaded into outlet coupling 16 (FIG. 4). After exiting the cavity 38, product flows between surface 44 of stem 42 and corresponding surface 46 in coupling 14. The annular opening between surfaces 44 and 46 is adjusted by turning stem 42 in or out of coupling 16, thereby controlling the back-pressure in cavity 38. Stem 42 is provided with two flats to facilitate screwing it into coupling 16, and with a lock-nut 48 for locking stem 42 in place. Port 50 is provided in coupling 14 for connection to a suitable cooling fluid supply. Cooling fluid flows through opening 52 and passes around "O"-ring 54, which acts as a check-valve to prevent product flow to the cooling system. The cooling fluid then flows through a narrow annular opening formed between the tip of coupling 16 and surface 56 of coupling 14, into cavity 58. Thus, in cavity 58, an annular flow sheet of cooling fluid interacts with an annular fluid sheet of hot emulsion, the two sheets flowing in opposite directions, thereby effecting intimate mixing and instantaneous cooling of the emulsion. The cooling fluid may be a compatible liquid or gas. For example, for oil-in-water emulsions, cold water may be used. In this case, the feed stock supplied to port 18 must contain a lower percentage of water, and the desired final oil/water ratio is accomplished by injecting the appropriate amount of cold water through port 50. Alternatively, gas may be used as a cooling fluid. For example, compressed air or nitrogen may be supplied to port 50 under pressure, to be injected into cavity 58, where the gas expansion from its compressed state requires heat absorption, thereby effecting instantaneous cooling of the hot emulsion. In this case, the air or nitrogen are released to atmosphere after the emulsion exits the emulsifying cello From cavity 58, the emulsion flows through annular opening 60, to outlet port 62 which is a ¼" H/P type. After exiting the emulsifying cell, the emulsion flows through a metering valve, provided to enable control of back-pressure in cavity 58 and to prevent "flashing" or sudden evaporation of liquid ingredient before temperature reduction.

Figure 5:
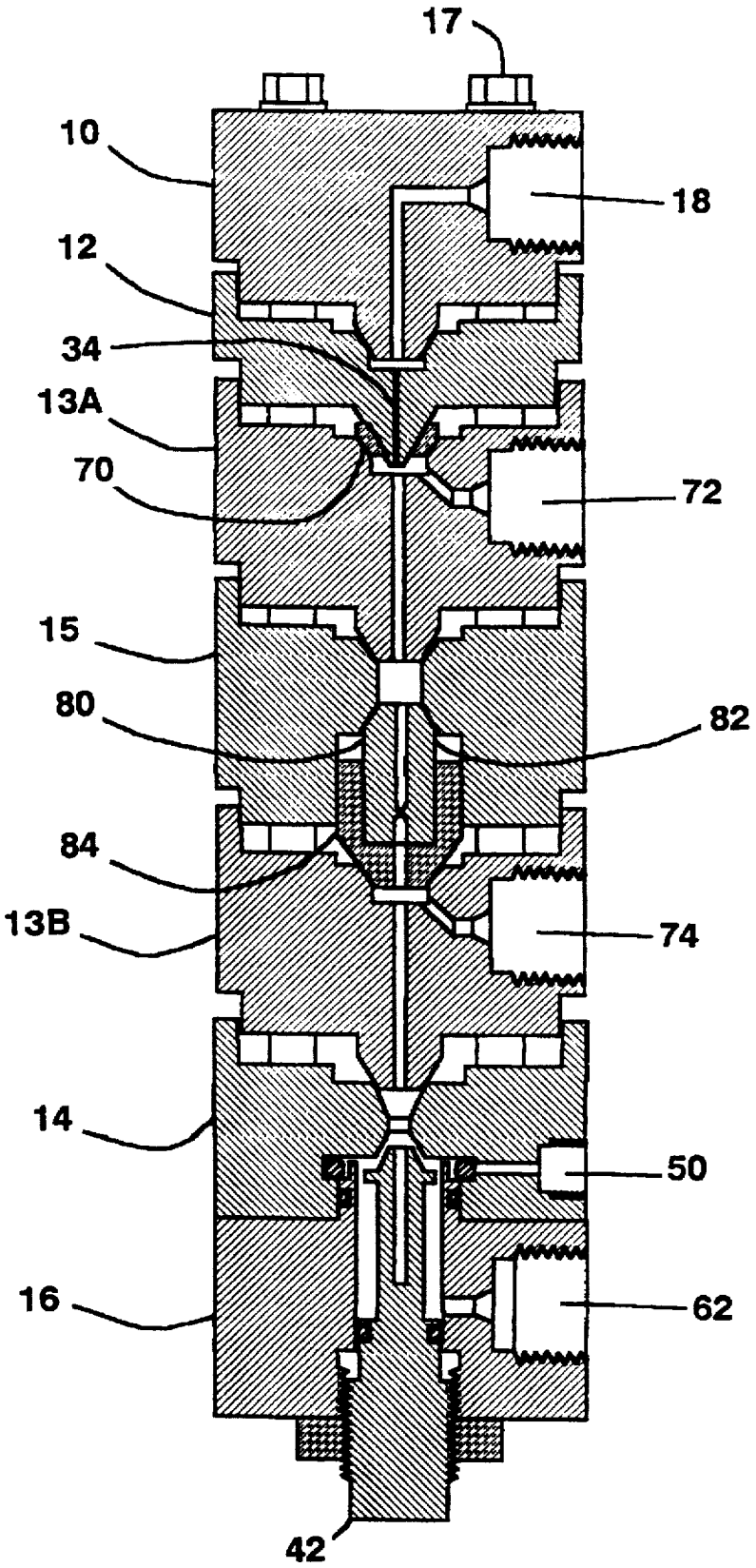
FIG. 5 is a cross-sectional view of another modular emulsifying cell assembly.

In the example of a more elaborate emulsifying cell shown in FIG. 5, multiple product inlet ports and multiple orifices are used. Couplings 10 and 12 are connected as described with respect to FIGS. 3 and 4. Couplings of the kind identified as 13A and 13B are provided to enable injection of other product ingredients through ports 72 and 74, which are ¼" H/P type, similar to port 18. Coupling 13 may be installed before or after coupling 12, or before or after coupling 15, in conjunction with one or more orifices, all depending on the particular product characteristics and the desired results. Nozzle adapter 70 is provided to enable high-pressure sealing between couplings 12 and 13A. Coupling 13 may be connected to another coupling 13 or to coupling 14 without any adapters. Coupling 15 contains a 2-piece nozzle assembly. Nozzle adapter 84 enables high-pressure sealing between the two orifice pieces 80 and 82, as well as between the 2-piece nozzle assembly and the coupling down-stream.

The product's continuous phase, water for example, is fed at high pressure through port 18 and then forced through orifice 34, thereby forming a water jet. Another ingredient, oil for example, is fed through port 72 at an appropriate pressure and temperature. The required oil pressure is a function of inlet water pressure at 18, the size of the orifice 34, and the size of the orifice formed by members 80 and 82. For example, using water pressure of 20,000 psi at 18, orifice of 0.015 in. dia. at 34, and round orifice of 0.032 in. dia. by members 80 and 82, then water pressure between the two orifices is slightly below 4,500 psi, and thus oil pressure of 4,500 is required at port 72 to assure oil flow into the emulsifying cell. At the interface between the water phase and oil phase, cavitation takes place due to hydraulic separation, effecting a homogeneous oil in water mixture at the exit of coupling 13A. The orifice formed between members 80 and 82 causes further break down of oil droplets, due to the severe acceleration with simultaneous pressure drop and due to orifice geometry. After this intense energy input, another product ingredient is added through port 74, for example emulsifier, which interacts with the process jet in a manner similar to the interaction between oil and water described above. The required feed pressure at port 74 is determined by the adjustment of stem 42, and will be generally in the range of 50 psi to 500 psi. This relatively low feed pressure enables use of ingredients that are difficult or impossible to pump with the high pressure process pump. For example, extremely viscous products and abrasive solids which would cause rapid wear to the plunger seals and check-valves of the high pressure pump, could be supplied to port 74 with standard industrial pumps. Port 74 may be also used for feeding melted polymers or resins, to be emulsified in liquid state into water, thereby replacing a common use of VOC's.

In the two different two-piece nozzle arrangements shown in FIG. 6, the orifice is formed as an open groove on the face of each nozzle member, thereby enabling fabrication of intricate orifice geometries and facilitating coating with suitable materials. For example, when members 80 and 82 are pressed together, they form a rectangular cross section orifice, with surfaces 86 and 88 of member 82 being optically flat (within 1 light band), forming a pressure containing seal with the corresponding surfaces of member 80. Surface 90 forms a step along the flow path in the orifice and serves to induce cavitation. The location of surface 90 along the orifice may be chosen to induce cavitation at the entrance of the orifice or at its exit, depending on the configuration of the emulsifying cell. Additionally, various slope angles of surface 90 and of the step formed after it may be used to control the rate of cavity formation and collapse, all depending on the product characteristics and desired results. The nozzle assembly made of members 92 and 94 will be essentially the same as a round hole in a solid block, but the two-piece construction allows coating of the inner surface the extremely small orifice with materials such as diamond, thereby enabling continuous production of abrasive products at high pressure. Such a scheme would be useful for producing small solid particles of materials such as ceramics or iron-oxide for magnetic media.

As seen in FIG. 5, the two nozzle members 80 and 82 are inserted into a bore in a nozzle adapter 84. The nozzle adapter is shown in greater detail in FIGS. 7A and 7B. Upon fastening the emulsifying cell assembly, the two nozzle members 80 and 82 are forced against surface 190 of adapter 84, while the adapter tapered sealing surface 188 is forced against the adjacent coupling (13B in FIG. 5). The axial compressive force on surface 188 has an inward radial component, which is transmitted through surface 186 to the two nozzle members 80 and 82, thereby effecting a pressure containing seal between the members 80 and 82. Slots 194 and 196 are provided to facilitate the translation of axial compression to radial compression of adapter 84. Round hole 192 is provided for product flow.

In the example of a more elaborate absorption cell shown in FIG. 9, the length of the cell and its effective internal diameter may be varied. Stem 242 has the same external dimensions as stem 42 in FIGS. 3, 4 and 5, thus stems 42 and 242 are interchangeable. Stem 242 is provided with a smooth internal bore 238 at one end, internal threads at the other end, and a tapered sealing surface 208 in between. Nozzle insert 200 is fitted into the stem bore 238, secured by such means as press-fitting or adhesive material, to form the cavity opening 236. The use of inserts with a variety of lengths, internal surface geometry and size, enables control of the shear rate, cavitation, turbulence, and the impact at surface 240. Rod 202 is inserted into stem 242 to provide the impact surface 240 of the absorption cell. The depth of cavity 238, as determined by the positioning of rod 202, controls the residence time of product in the absorption cell, which in turn enables providing sufficient interaction time between emulsifier and oil droplets. Sleeve 204 is provided to lock rod 202 in place, as well as to provide sealing between rod 202 and stem 242. Once the location of rod 202 is selected, sleeve 204 is tightened. Tapered sealing surface 206 of sleeve 204 is then pressed against tapered sealing surface 208 of stem 242, thereby forming a seal between sleeve 204 and stem 242, as well as between sleeve 204 and rod 202. Graduation marks at the exposed end of rod 202 facilitate accurate positioning of the rod and provide a convenient scale for recording.

Figure 10:
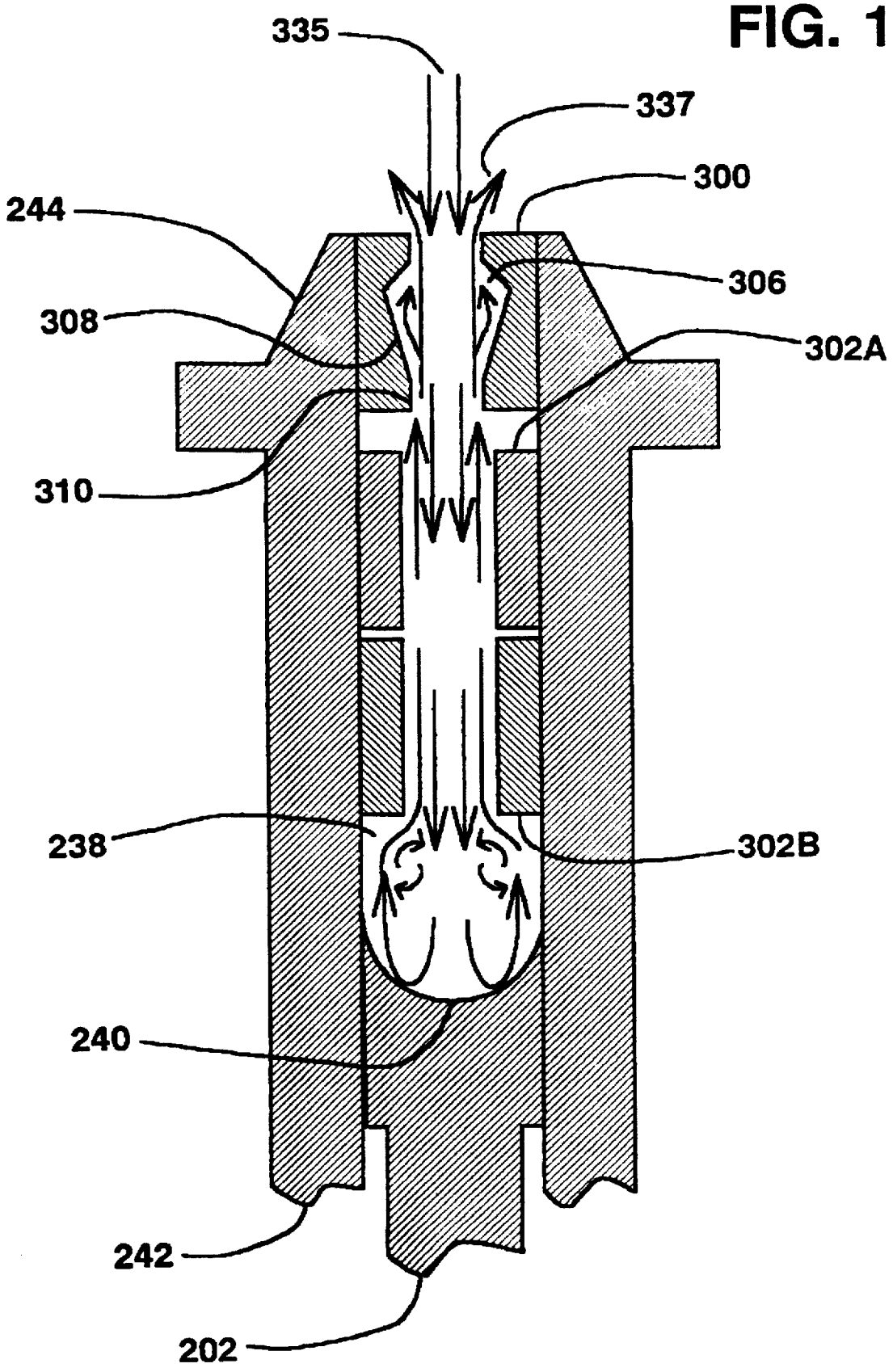
FIG. 10 and 11 are cross-sectional diagrams, not to scale, of fluid flow in other modular absorption cell assemblies.
Figure 11:
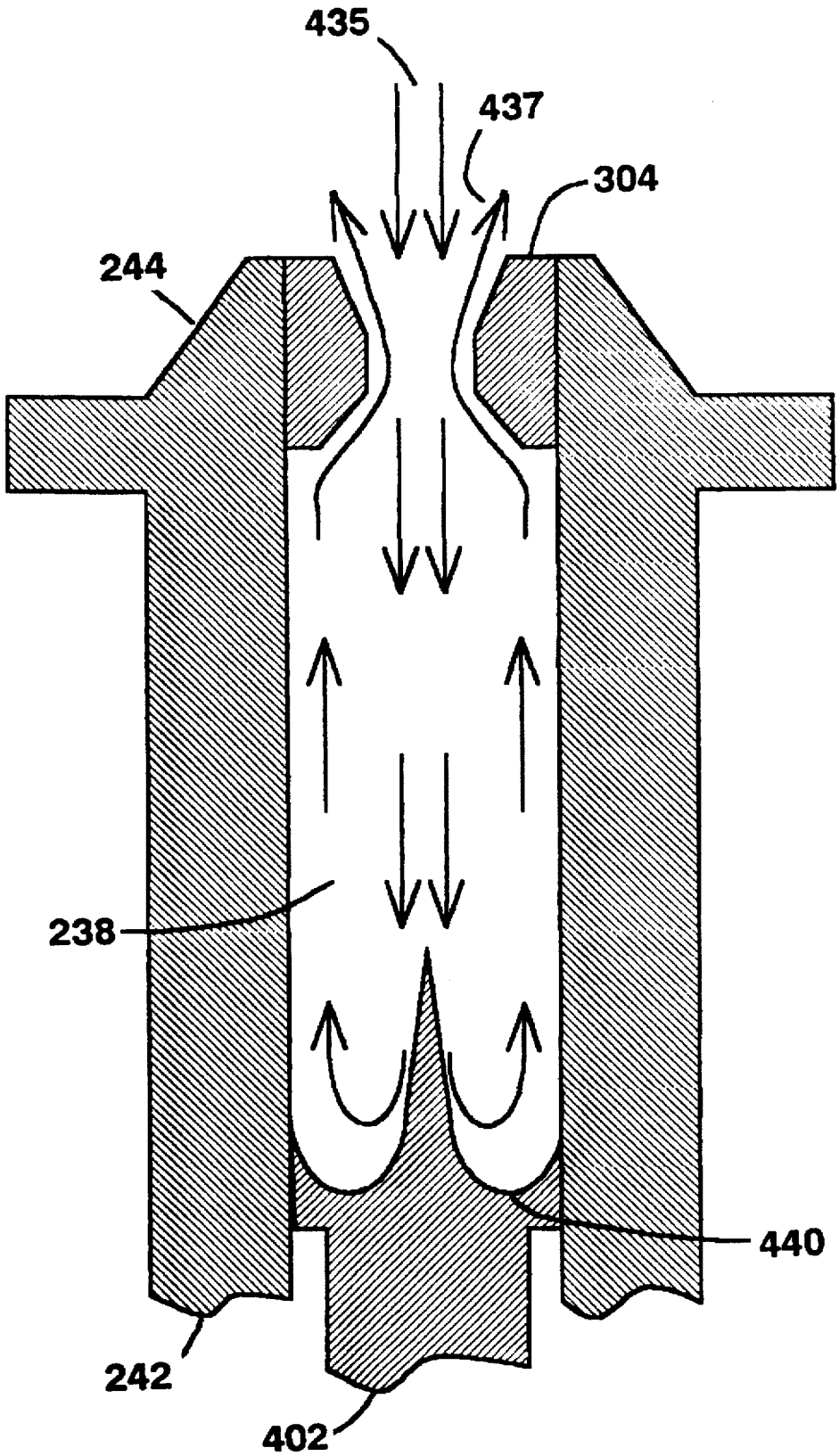

The two absorption cell assemblies in FIGS. 10 and 11 exemplify a large variety of ways to accommodate particular product requirements. Nozzle inserts 300, 302A, 302B and 304 are examples of a large variety of inserts that may be used. The generally concave internal opening of insert 300 induces cavitation when fluid enters cavity 306. The fluid immediately near surface 308 will flow along a path defined by that surface, tending to separate form the flow path defined by the previous surface 310. With simultaneous pressure drop resulting from the larger cross-section area of cavity 306, cavitation occurs. The generally convex internal opening of insert 304 (FIG. 11) induces cavitation in the fluid stream upon exiting the insert. Fluid pressure is increased momentarily when fluid passes through the center of insert 304. As in insert 300, the fluid's tendency to follow the shape of the solid surface with a simultaneous pressure drop induces cavitation. Inserts 302A and 302B are identical and are arranged to achieve desired results for a particular product. Several identical inserts such as 302 may be used together, end-to-end, to form one continuous internal bore. Alternatively, several inserts with different internal diameters may be used to induce turbulence in the exiting fluid stream. Yet another alternative, shown in FIG. 10, is to leave a small space between the inserts to disrupt laminar flow and generate turbulence. Yet another alternative is to use several inserts such as 300 and/or 304 in series. In FIG. 11, reflecting surface 440 exemplifies a large variety of shapes that may be used to enhance its function or for a particular application. As compared with semi-spherical or flat reflecting surfaces, surface 440 has a much larger surface area reflecting the jet fluid. Such a scheme may be used to effect a more gradual flow reversal, and for abrasive solids applications for extending the service life of the reflecting surface.

Figure 12A:
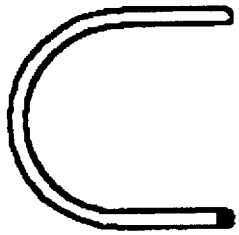
FIGS. 12A, 12B and 12C are an end view, a front view, and a top view of a coil for regulating process pressure in the emulsifying cell.
Figure 12C:
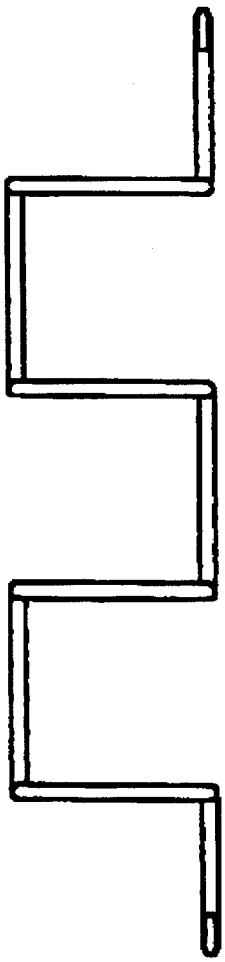
Figure 12B:
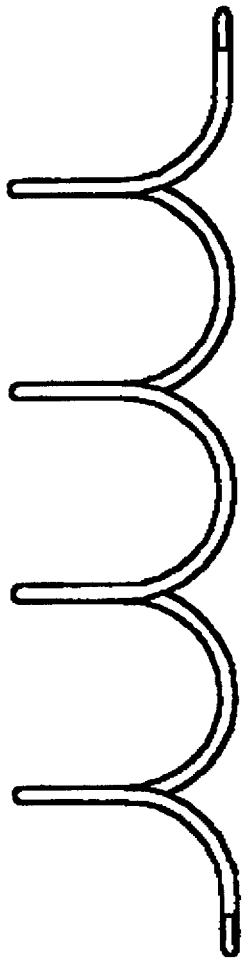
Figure 13:
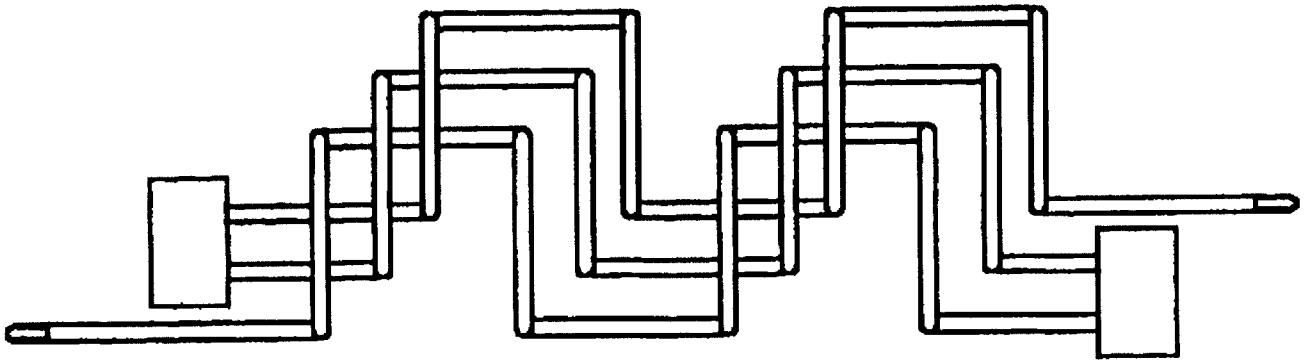
FIG. 13 is an assembly of three coils shown in FIGS. 12A through 12C.

The coil shown in FIGS. 12A through 12C is used for removing pressure fluctuations (item 132 in FIGS. 1 and 2). The coil is made of standard high pressure tubing (E.g., Butech ¼" M/P, #20-109-316), with coil diameter sufficiently large as not to effect significantly the pressure rating of the tubing (e.g., 4 in.), and of sufficient length to remove the pressure spikes (e.g., 60 ft.). The tubing expands slightly when the pump generates a pressure spike, thereby acting to absorb the excess energy generated by the pressure spike. At the end of the pressure spike, the tubing contracts, thereby releasing the stored energy. This action of the coil is similar to the action of standard hydraulic accumulators that are used in hydraulic systems for essentially the same purpose. Waterjet cutting systems employ similar principle (e.g. Flow International Corp.'s "Attenuator"), in the form of a long straight cylinder between the high pressure intensifier pump and the nozzle, for generating constant flow rate through the nozzle. As can be seen in FIGS. 12A through 12C, the tubing is coiled in a way that allows each coil ring to flex in response to pressure fluctuations, in a similar action of a Bourdon tube (used in pressure gauges). Because the external side of each coil ring has a larger area than the internal side, pressure in the tubing tends to open each ring. This movement in response to pressure fluctuations provides another mechanism for absorbing and releasing energy. The coil thus provides means for removing pressure fluctuations, heating or cooling the product, while being suitable for CIP/SIP sterile systems. FIG. 13 illustrates a scheme for connecting several coils such as in FIGS. 12A through 12C, enabling the use of standard tubing length (e.g. 20 ft.) and standard bending tools to produce coils as long as necessary.

Other embodiments are within the scope of the following claims.

What is claimed is:

1. A method of causing emulsification comprising delivering a coherent jet of fluid having a velocity greater than 500 feet per second, providing a second, coherent flow of fluid, and in a chamber, directing the coherent jet and the coherent flow along paths that maintain a boundary between the jet and coherent flow in a manner to produce shear, and hence mixing, at the boundary.

2. The method of claim 1 further comprising orienting the paths in essentially opposite directions.

3. The method of claim 1 further comprising configuring the coherent flow as a cylinder surrounding the jet.

4. The method of claim 1 including interposing a reflecting surface in the path of said jet.

5. The method of claim 4 wherein the reflecting surface is generally semi-spherical.

6. The method of claim 4 wherein the reflecting surface is generally tapered.

7. The method of claim 4 wherein the reflecting surface lies at the end of a well which has an opening in the path of said jet.

8. The method of claim 7 further comprising adjusting the pressure in the well.

9. The method of claim 7 further comprising adjusting the distance from the opening of the well to the reflecting surface.

10. The method of claim 7 further comprising means for varying the size of the opening to the well.

11. The method of claim 7 further comprising directing the second coherent flow flow, as it exits the well, in an annular sheet away from the opening of the well.

12. The method of claim 11 further comprising directing an annular flow of a coolant in a direction opposite to the direction of the annular sheet.

13. An apparatus for use in emulsification, comprising a nozzle arranged for delivering a coherent jet of fluid having a velocity greater than 500 feet per second, and an elongated chamber having an open end for receiving said jet of fluid, a reflective surface at the other end of the chamber for reflecting the jet, and a mechanism for adjusting the distance from the reflective surface to the open end.

14. The apparatus of claim 13 further comprising interchangeable reflective surfaces, each suitable for a different application.

15. The apparatus of claim 13 further comprising a removable insert for insertion into the chamber at the open end, the insert having an orifice of a smaller dimension than the inner wall of the chamber.

16. The apparatus of claim 15 further comprising interchangeable inserts, each suitable for a different application.

17. A method for causing emulsification in a fluid, comprising directing a jet of fluid along a first path, and using a reflecting surface at the end of a well having a variable size opening, causing the fluid to be redirected in a controlled flow along a new path, the first path and the new path being oriented to cause shear and cavitation in the fluid.

18. A method for causing emulsification in a fluid, comprising directing a jet of fluid along a first path, using a reflecting surface at the end of a well to cause the, fluid to be redirected in a controlled flow along a new path, the first path and the new path being oriented to cause shear and cavitation in the fluid, and directing the controlled flow, as it exits the well, in an annular sheet away from the opening of the well.

19. A method of claim 18 further comprising directing an annular flow of a coolant in a direction opposite to the direction of the annual sheet.

20. The method of any one of claims 6–12, 13, 1, or 17–19 comprising causing emulsification of at least two immiscible, non-reactive components.

* * * * *